US007377821B2

(12) United States Patent
Chen et al.

(10) Patent No.: US 7,377,821 B2
(45) Date of Patent: May 27, 2008

(54) ELECTRICAL CONNECTOR

(75) Inventors: Ran Chen, Kunshan (CN); Yu-Hua Mao, Kunshan (CN); Wei Li, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/714,496

(22) Filed: Mar. 6, 2007

(65) Prior Publication Data

US 2007/0207680 A1 Sep. 6, 2007

(51) Int. Cl.
*H01R 13/64* (2006.01)

(52) U.S. Cl. ..... 439/680; 439/607

(58) Field of Classification Search ..... 439/378, 439/674, 607, 677, 680, 681
See application file for complete search history.

(56) References Cited

U.S. PATENT DOCUMENTS 5,356,300 A * 10/1994 Costello et al. ..... 439/101
5,620,329 A * 4/1997 Kidd et al. ..... 439/248
6,565,390 B2 * 5/2003 Wu ..... 439/680
6,869,319 B2 * 3/2005 Yamada et al. ..... 439/681
6,957,985 B1 * 10/2005 Wang ..... 439/680
7,048,554 B2 * 5/2006 Wang ..... 439/79
D525,940 S 8/2006 Zhang et al.
2005/0287839 A1 * 12/2005 Wang ..... 439/74
2007/0207680 A1 * 9/2007 Chen et al. ..... 439/680

* cited by examiner

*Primary Examiner*—James Harvey
(74) *Attorney, Agent, or Firm*—Wei Te Chung

(57) ABSTRACT

An electrical connector comprises an insulating housing defining a receiving space with an inserting port, a pair of guiding slot on two lateral sides of the receiving space and a plurality of first and second contact receiving channels, and a plurality of signal and power contacts respectively received in the first and the second contact receiving channels. The insulating housing has at least one protruding portion in front of the second contact receiving channel, a distance between the protruding portion and an opposed face of the insulating housing is narrow than a dimension of the guiding slot in a vertical direction to prevent a guiding post of a complementary connector from inserting into the second channel by mistake.

9 Claims, 4 Drawing Sheets

ELECTRICAL CONNECTOR

BACKGROUND OF THE INVENTION

1. Field of the Invention

The present invention relates to an electrical connector which has power contacts.

2. Description of Related Art

An electrical Connector is widely used in electrical equipments, such as computer, mobile telephone, electrograph, etc, the electrical connector mates with a complementary connector and electrically connects with a print circuit board to provide an electrical connection between two electrical equipments. Usually, the electrical connector has a guiding portion for easily insertion of the complementary connector.

U.S. Pat. No. D525,940 discloses such an electrical connector with a guiding portion, the electrical connector comprises an insulting housing, a plurality of signal contacts and power contacts retained in the insulating housing, a shielding cover and a board locking member assembled to the insulating housing. The insulating housing has a mating portion engaging with a complementary connector, the mating portion has a mating port which defines a plurality of contact receiving slot, receiving slots for the power contacts are arranged on two opposed sides of receiving slots for the signal contacts. A pair of guiding portions are defined on two ends of the mating port near the receiving slots for the power contacts, the guiding portion is a guiding slot, which communicates with the mating port to guide a guiding post of the complementary connector. However, since the height of receiving slots for the power contacts is approximately equal that of the guiding slot, when the electrical connector engages with the complementary connector, the guiding post of the complementary connector may inserts into the receiving slots for the power contacts by mistake and damages the power contacts.

Hence, an improved connector is required to overcome the disadvantages of the prior art.

SUMMARY OF THE INVENTION

An object of the present invention is to provide a connector which can prevent power contacts from damage.

Accordingly, to achieve above-mentioned object, an electrical connector comprises an insulating housing and a plurality of signal and power contacts retained in the insulating housing. The insulating housing has a mating portion with a mating face, a receiving space with an inserting port on the mating face, a pair of guiding slots communicating with and being on lateral sides of the receiving space, and a plurality of first and second contact receiving channels formed on a top and a bottom inner surfaces of the receiving space. The second contact receiving channels are disposed in two sides of the first contact receiving channels and are adjacent to the guiding slots. A dimension of a part of the inserting port corresponding to the second contact receiving channels is smaller than a dimension of the guiding slot in a vertical direction. The signal contacts are received in the first contact receiving channels, and the power contacts are received in the second contact receiving channels.

Other objects, advantages and novel features of the present invention will become more apparent from the following detailed description of the present embodiment when taken in conjunction with the accompanying drawings.

DETAILED DESCRIPTION OF THE INVENTION

Figure 1:
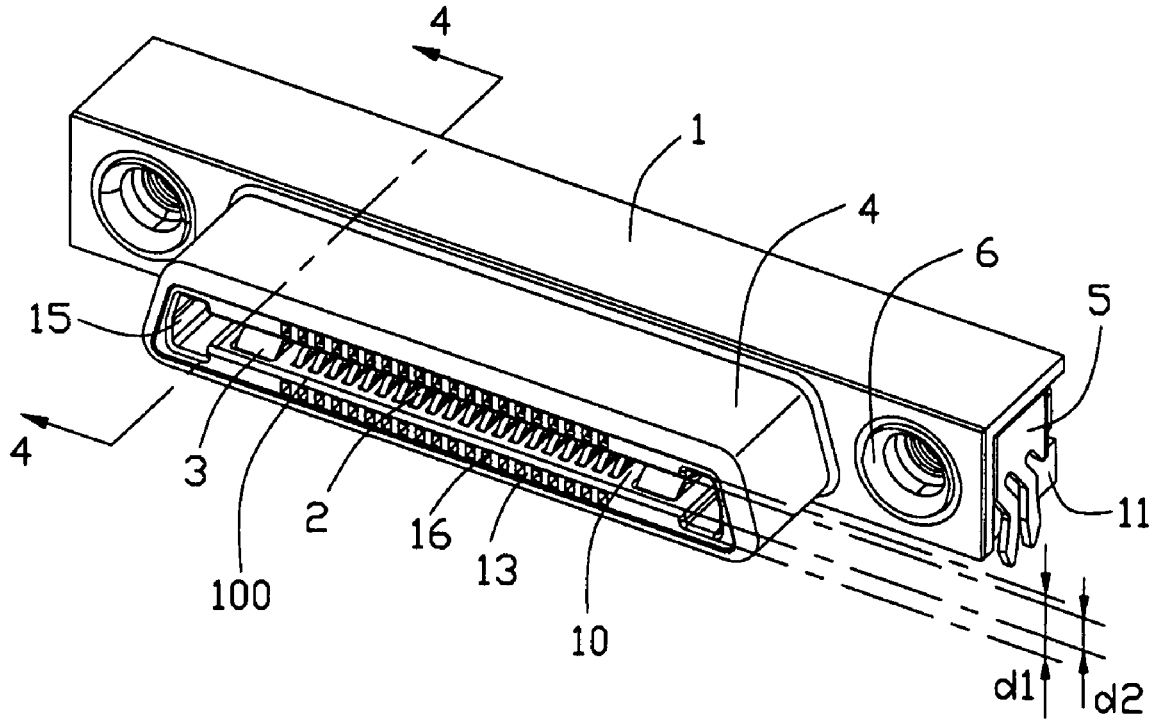
FIG. 1 is an assembled, perspective view of an electrical connector of the present invention.

Reference will now be made in detail to the preferred embodiment of the present invention.

Referring to FIGS. 1 to 4, an electrical connector in accordance with the present invention comprises an insulating housing 1, a plurality signal contacts 2 and power contacts 3, a shielding cover 4, a board locking member 5 and a pair of retainers 6.

The insulating housing 1 is formed with a longitudinal base 11 and a mating portion 12 forwardly extending from the base 11 for engaging with a complementary connector (not shown), the mating portion 12 has a mating face 13. The base 11 defines two through holes 14 respectively on two lateral sides of the mating portion 12 for receiving the retainers 6.

The insulating housing 1 defines a receiving space 10 with an inserting port 100 on the mating face 13, two guiding slots 15 on two lateral ends of the receiving space 10 which communicating with the receiving space 10 and passing through the mating face 13. When the electrical connector in accordance with the present invention engages with the complementary connector, the guiding slots 15 is used to receive and guiding corresponding guiding post of the complementary connector. The mating portion 12 has two opposed sidewalls 18, 19 and two end walls linking the sidewalls 18, 19, a distance between the opposed sidewalls 18, 19 is smaller than a dimension of the guiding slots 15, referring as d2, in a vertical direction. Both of the sidewall 18, 19 define a plurality of contact receiving channels, which comprises a plurality of first contact receiving channels 16 and a plurality of second contact receiving channels 17 wider than the first contact receiving slots 16.

The second contact receiving channels 17 are divided into two groups and arranged on two sides of the first contact receiving channels 16, the guiding slots 15 are on two lateral sides of the contact receiving channel 16, 17, that means guiding slots 15 are adjacent to the second contact receiving channels 17. In present embodiment, a width of the second contact receiving channels 17 is substantially equal with a width of the guiding slots 15 along a contact arrangement direction. Each of the sidewalls 18, 19 has a protruding portion 170 in a front of the second contact receiving channels 17, whose outside surface is a part of the mating face 13, a dimension, referring as d1, between top faces of the opposed protruding portions 170 is smaller than the dimension d2 of the guiding slots 15 in the vertical direction.

Figure 2:
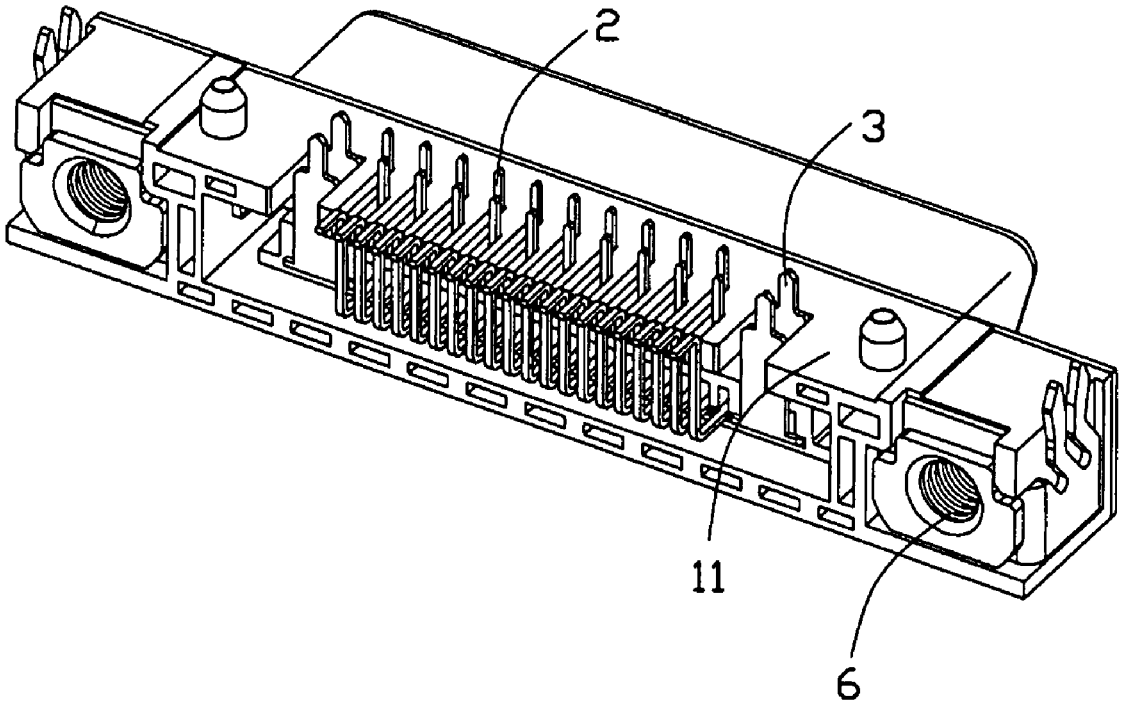
FIG. 2 is another assembled, perspective view the electrical connector of the present invention from another side.

Referring to FIG. 2, the signal contact 2 is a spring contact and comprises a retaining portion 20, a contacting arm 21 extending from an end of the retaining portion 20, a bend portion 22 bended vertically and downwardly from the other end of the retaining portion 20 and a soldering portion 23 outwardly bended from the bend portion 22 and substantially paralleling the retaining portion 20. The contacting arm 21 has an elastic contacting portion (not labeled)

extending into the receiving space 10 to electrically contact with the complementary connector. The signal contacts 2 are received in the first contact receiving channels 16 by the retaining portion 20 interferentially engaging with the insulating housing 1.

The power contacts 3 is wider than the signal contacts 2, the power contacts 3 also are spring contact and comprises a retaining portion 30, a contacting arm 31 extending from an end of the retaining portion 30, a bend portion 32 bended vertically and downwardly from the other end of the retaining portion 30 and a soldering portion 33 on an end of the bend portion 32. The contacting arm 31 has an elastic contacting portion (not labeled) extending into the receiving space 10 to electrically contact with the complementary connector. The power contacts 3 are received in the second contact receiving channels 17 by the retaining portion 30 interferentially engaging with the insulating housing 1.

The shielding cover 4 has a plane portion 41 covering the base 11 of the insulating housing 1 and a mating frame 42 surrounding and covering the mating portion 12 of the insulating housing 1. The plane portion 41 is formed with a pair of retaining holes 40 on two sides of the mating frame 42 and corresponding to the through holes 14 for receiving the retainers 6.

Figure 3:
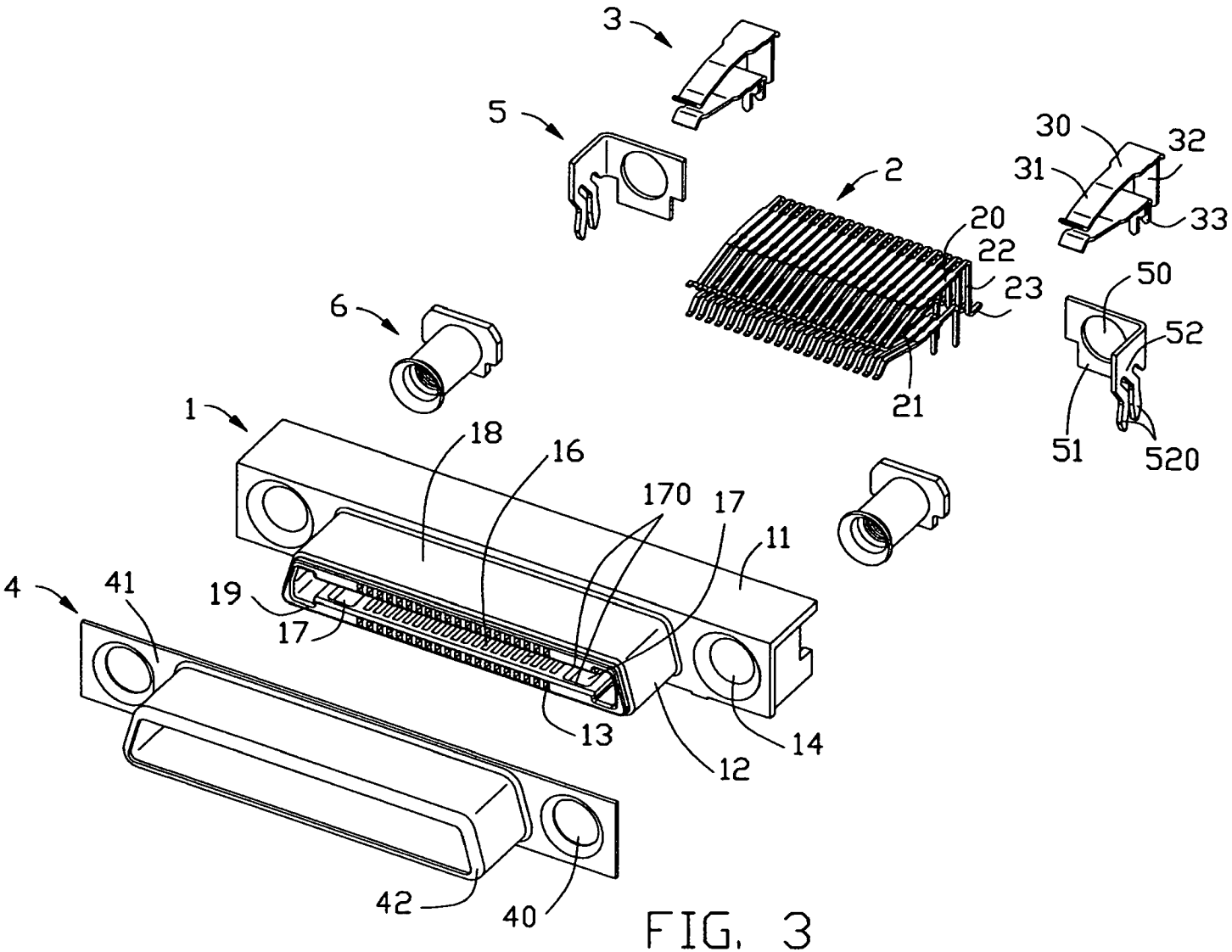
FIG. 3 is an exposed, perspective view of the electrical connector.
Figure 4:
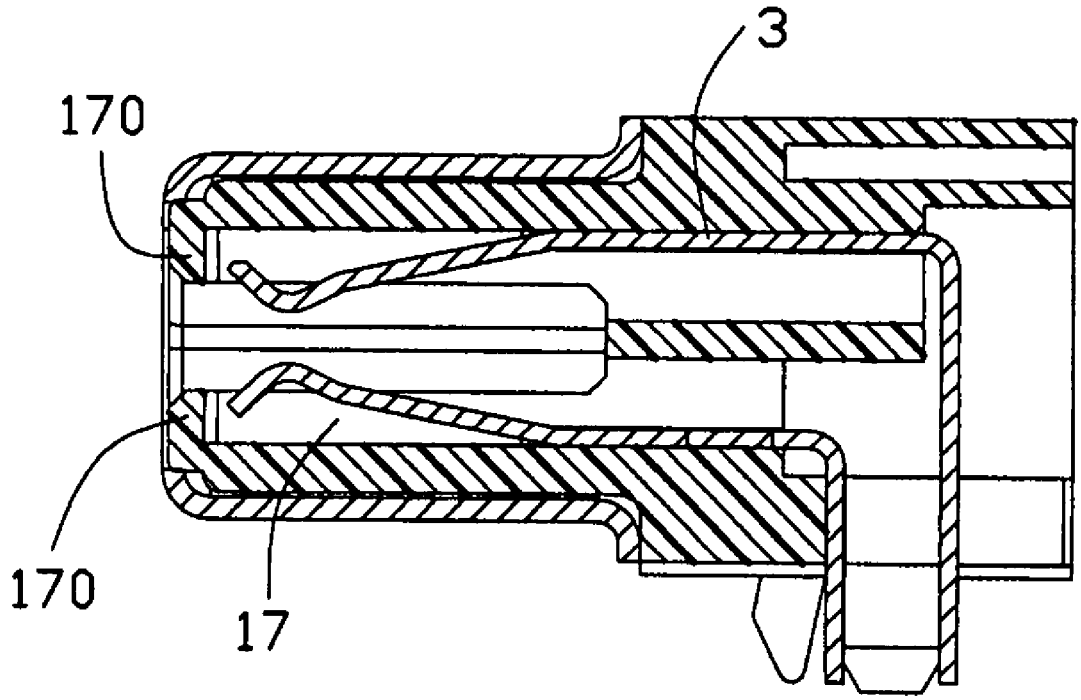
FIG. 4 is cross sectional view of the electrical connector, taken from line 4-4 in FIG. 1.

Referring to FIG. 3, the board locking member 5 has a mounting portion 51 mounting to the base 11 of the insulating housing 1 and a board locking portion 52 vertical bended from the mounting portion 51. The mounting portion 51 defines a hole 50, which is corresponding to the through hole 14 and the retaining hole 40 for receiving the retainer 60. The board locking portion 52 has two clasping legs 520 for clasping a print circuit board (not shown).

Referring to FIGS. 1 and 2, the retainer 6 assembles the shielding cover 4, the board locking member 5 and the insulating housing 1 together by passing through the retaining hole 40 of the shielding cover 4, the hole 50 of the board locking member 50 and the through hole 15 of the insulating housing 1.

When the electrical connector mates with the complementary connector, the protruding portion 170 of the insulating housing 1 can prevent the guiding post of the complementary connector (not shown) from inserting into the second contact receiving channel 17 by mistake, so the power contacts 3 can be protected by the protruding portions 170.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulating housing having a mating portion with a mating face, a receiving space with an inserting port on the mating face, a pair of guiding slots communicating with and being on lateral sides of the receiving space, and a plurality of first and second contact receiving channels formed on a top and a bottom inner surfaces of the receiving space, the second contact receiving channels disposed in two sides of the first contact receiving channels and being adjacent to the guiding slots, a dimension of a part of the inserting port corresponding to the second contact receiving channels being smaller than a dimension of the guiding slot in a vertical direction;

a plurality of signal and power contacts retained in the insulating housing, the signal contacts being received in the first contact receiving channels, the power contacts being received in the second contact receiving channels.

2. The electrical connector as described in claim 1, wherein the insulating housing is formed with at least one protruding portion in front of the second contact receiving channel.

3. The electrical connector as described in claim 2, wherein a front face of the protruding portion is a part of the mating face of the mating portion.

4. The electrical connector as described in claim 3, wherein the power contact is wider than the signal contact, and the second contact receiving channel is wider than the first contact receiving channel.

5. The electrical connector as described in claim 2, wherein the insulating housing has a plurality of the second contact receiving channels on two lateral opposed ends of the top and the bottom inner surfaces of the receiving space, respectively.

6. An electrical connector comprising:

an insulating housing having a mating portion with a mating face, a receiving space with an inserting port on the mating face, a pair of guiding slots communicating with and being on lateral sides of the receiving space, and a plurality of first and second contact receiving channels on a top and a bottom inner surfaces of the receiving space, the insulating housing having at least one protruding portion in front of the second contact receiving channel, a dimension between a top face of the protruding portion and an opposed face of the insulating housing being narrower than a dimension of the guiding slot in a vertical direction;

a plurality of signal and power contacts retained in the insulating housing, the signal contacts being received in the first contact receiving channels, the power contacts being received in the second contact receiving channels.

7. The electrical connector as described in claim 6, wherein the power contact is wider than the signal contact, the second contact receiving channel is wider than the first contact receiving channel, and the second contact receiving channels are disposed on two sides of the first contact receiving channels and are adjacent to the guiding slots.

8. The electrical connector as described in claim 6, wherein a front face of the protruding portion is a part of the mating face of the mating portion.

9. The electrical connector as described in claim 8, wherein the insulating housing has a plurality of the second contact receiving channels on two lateral opposed ends of the top and the bottom inner surfaces of the receiving space, respectively.

* * * * *